US008752236B2

(12) United States Patent
Oh et al.

(10) Patent No.: US 8,752,236 B2
(45) Date of Patent: Jun. 17, 2014

(54) STEAM VACUUM CLEANER

(75) Inventors: Jang-Keun Oh, Gwangju (KR); Hyoun-Soo Kim, Geumjeong-Gu (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1448 days.

(21) Appl. No.: 12/206,170

(22) Filed: Sep. 8, 2008

(65) Prior Publication Data

US 2009/0064448 A1 Mar. 12, 2009

Related U.S. Application Data

(63) Continuation-in-part of application No. 12/071,620, filed on Feb. 25, 2008, now abandoned.

(30) Foreign Application Priority Data

Sep. 7, 2007 (KR) ..... 10-2007-0091234
Jul. 7, 2008 (KR) ..... 10-2008-0065477

(51) Int. Cl.
*A47L 7/00* (2006.01)

(52) U.S. Cl.
USPC ..... 15/320; 15/321; 15/322

(58) Field of Classification Search
USPC ..... 15/320, 321, 322
See application file for complete search history.

(56) References Cited

U.S. PATENT DOCUMENTS 6,571,421 B1 * 6/2003 Sham et al. ..... 15/320
7,373,690 B2 * 5/2008 Sepke et al. ..... 15/410
7,891,047 B2 * 2/2011 Milanese ..... 15/320
2006/0090284 A1 5/2006 Chen
2008/0284363 A1 * 11/2008 Lucas et al. ..... 318/441

FOREIGN PATENT DOCUMENTS

JP 5-184496 A 7/1993
JP 6-311946 A 11/1994
JP 2000-041926 A 2/2000
KR 1020020059259 A 7/2002
KR 1020050014652 * 2/2005 ..... A47L 11/34
KR 1020050014652 A 2/2005
KR 1020050014652 A 2/2005
KR 1020050032699 A 4/2005
KR 20-0426851 Y1 9/2006

* cited by examiner

*Primary Examiner* — Lee D Wilson
*Assistant Examiner* — Shantese McDonald
(74) *Attorney, Agent, or Firm* — Blank Rome LLP

(57) ABSTRACT

A steam vacuum cleaner, having a suction port assembly including a suction hole formed on a bottom surface thereof and a dust receptacle detachably attached to the suction port assembly; a pump disposed in the suction port assembly to suction dust-laden air from an object being cleaned and to transfer the dust laden air to the dust receptacle; a steam unit disposed on the suction port assembly; a floorcloth unit disposed on the suction port assembly to scrub the object using steam supplied from the steam unit; and a handle member hinged with a portion of the suction port assembly, wherein the handle member has a variable length. Floorcloth plates having a plurality of steam passages radially formed on the bottom surface thereof may be rotatably mounted on the bottom surface of the suction port assembly.

12 Claims, 24 Drawing Sheets

STEAM VACUUM CLEANER

CROSS-REFERENCE TO RELATED APPLICATIONS

This application is a continuation-in-part of U.S. patent application Ser. No. 12/071,620, filed Feb. 25, 2008, which claims the benefit under 35 U.S.C. §119 of Korean Patent Application No. 2007-0091234, filed Sep. 7, 2007, in the Korean Intellectual Property Office, the entire disclosures of which are hereby incorporated by reference. This application also claims the benefit under 35 U.S.C. §119 of Korean Patent Application No. 2008-65477 filed Jul. 7, 2008, in the Korean Intellectual Property Office, the entire disclosure of which is incorporated herein by reference.

FIELD OF THE INVENTION

The present invention relates to a vacuum cleaner, and more particularly, to a steam vacuum cleaner having vacuum cleaning and steam cleaning functions to increase cleaning efficiency.

BACKGROUND OF THE INVENTION

A steam vacuum cleaner having both vacuum cleaning and steam cleaning functions is available. This type of vacuum cleaner can vacuum an object, while concurrently ejecting steam onto the object so as to remove contaminants from the object more efficiently.

Conventional general steam vacuum cleaners can use a limited level of power, which is generally 2000 W (Watt) at the maximum. It is necessary to employ additional high voltage components, including a high voltage line, in order for these vacuum cleaners to use more than 2000 W of power, resulting in a price increase of the vacuum cleaners.

Conventional general steam vacuum cleaners include a suction motor which consumes approximately 1300 W of power, and a small-sized heater unit which consumes approximately 700 W of power for steam cleaning. Conventional steam vacuum cleaners have inferior performance compared to steam-only cleaners, which consume approximately 1200 W of power and employ a large-sized heater unit (approximately 800 cc capacity). A small-sized heater unit also has the drawback that components such as ejection nozzles are frequently blocked and become inoperable by formation of a scale coating inside the heater unit, such as hard incrustation of calcium ($Ca^{2+}$) and magnesium ($Mg^{2+}$). A conventional general steam vacuum cleaner has a large-sized body and a long handle member to adjust a suction port assembly, and a user may experience inconvenience when storing the steam vacuum cleaner.

SUMMARY OF THE INVENTION

An object of the present invention is to provide a steam vacuum cleaner, comprising a suction port assembly including a suction hole formed on a bottom surface thereof and a dust receptacle detachably attached to the suction port assembly; a pump disposed in the suction port assembly to suction dust-laden air from an object being cleaned and to transfer the dust laden air to the dust receptacle; a steam unit disposed on the suction port assembly; a floorcloth unit disposed on the suction port assembly to scrub the object using steam supplied from the steam unit; and a handle member hinged with a portion of the suction port assembly, wherein the handle member has a variable length. The pump may include an impeller formed on a passage connecting the suction hole and the dust receptacle; and a first motor disposed outside of the passage to drive the impeller. The handle member may include a first member having one end connected to the suction port assembly and at least one pair of protrusions longitudinally disposed at predetermined intervals; and a second member hinged with another end of the first member, that folds into a folded position in which it contacts the first member without contacting the pair of protrusions.

The floorcloth unit may include at least two floorcloth plates rotatably mounted on the bottom surface of the suction port assembly, wherein a floorcloth is attached to a bottom surface of each floorcloth plate; and a rotation driving part to drive the at least two floorcloth plates, wherein each floorcloth plate includes a plurality of steam passages radially formed on the bottom surface of the floorcloth plate. The at least two floorcloth plates guide steam supplied from the steam unit to the steam passage of the floorcloth plates through a pair of connecting shafts of the floorcloth plates.

The steam unit may include a water tank; a heater housing; a sheath heater, wherein a part of the sheath heater is inserted into the heater housing; and a pump to supply water stored in the water tank to the heater housing. Alternatively, the steam unit may include a water tank and a sheath heater, wherein a part of the sheath heater is inserted into the water tank.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, the same reference numerals used to identify the same parts, components, and structures, unless otherwise noted.

DETAILED DESCRIPTION OF THE EXEMPLARY EMBODIMENTS

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
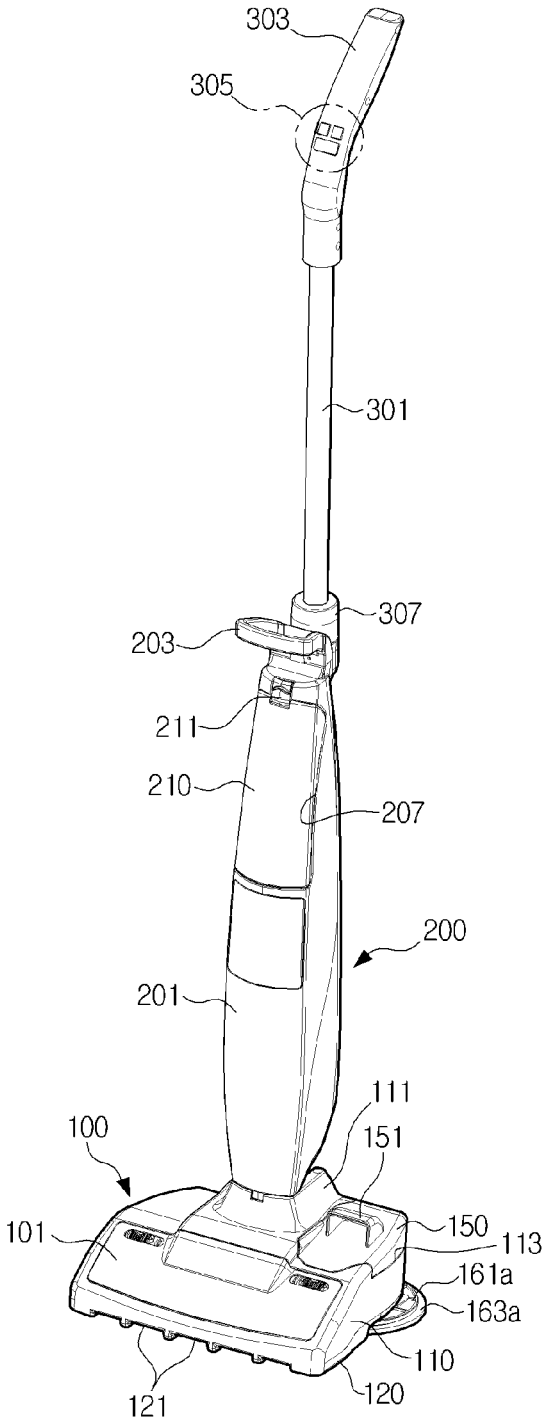
FIG. 1 is a front perspective view of a steam vacuum cleaner according to a first exemplary embodiment of the present invention.
Figure 2:
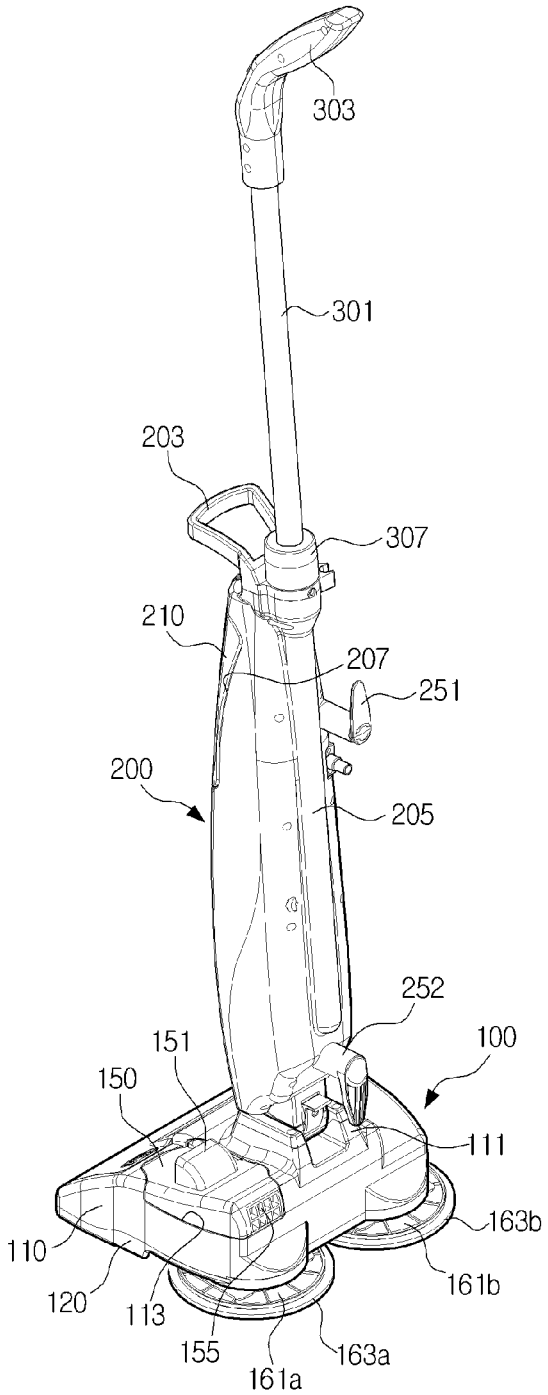
FIG. 2 is a rear perspective view of a steam vacuum cleaner according to a first exemplary embodiment of the present invention.

Referring to FIGS. 1 and 2, a steam vacuum cleaner according to a first exemplary embodiment of the present invention includes a suction port assembly 100, a main body 200, a handle member 301, and a handle 303. The suction port assembly 100 may be hinged with respect to the main body 200 for easy operation by a user. Accordingly, the user may grip the handle 303 and tilt the main body 200 backward with respect to the suction port assembly 100 while operating the vacuum cleaner.

Referring to FIGS. 1 to 4, the suction port assembly 100 may include an upper casing 110, a lower casing 120, a drum brush 125, a motor 130, an impeller 135, a dust receptacle 150, a rotating unit 160, and a pair of floorcloth plates 161*a* and 161*b*.

The upper casing 110 may include a hinge part 111 engaged with a hinge axis 202 (FIG. 10) formed on a lower rear portion of the main body 200, and a hole 113 formed to receive the dust receptacle 150. A translucent cover 101 is removably attached to the upper casing 110 to allow a user to view the drum brush 125 (FIG. 3) rotating inside the suction port assembly 100. Since a user can see that the drum brush 125 is rotating during cleaning operation through the translucent cover 101, the user can immediately identify a problem occurring in the drum brush 125, such as non-rotation of the drum brush 125 due to foreign substance clogging the suction port 123. As a result, problems such as motor overload can be avoided.

Figure 3:
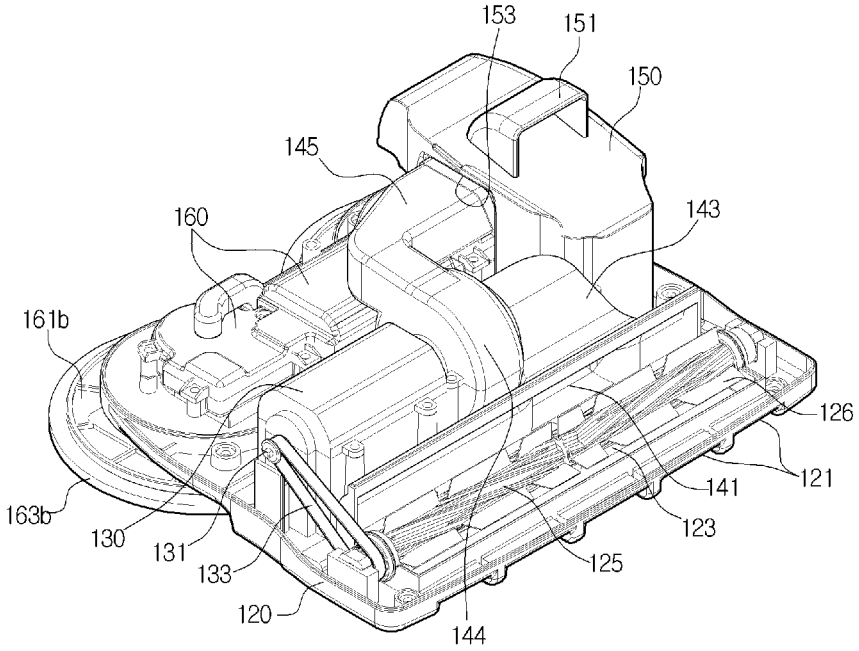
FIG. 3 is a perspective view of a suction port assembly from which an upper cover illustrated in FIG. 1 is removed.

The lower casing 120 may be detachably engaged with the lower portion of the upper casing 110, to define a space with the upper casing 110 to protect the elements housed therein, such as the drum brush 125, the motor 130, and the impeller 135. Referring to FIG. 3, the lower casing 120 includes the suction port 123 extending widthwise along the lower front side to draw in dust and air from an object being cleaned. The drum brush 125 is rotatably mounted within the suction port 123. The outer circumference of the drum brush 125 is engaged with a plurality of cleaning ribs 126 made of a soft material.

The lower casing 120 includes passages formed therein for dust entering through the suction port 123 to flow to the dust receptacle 150. The passages may include a first passage 143, an impeller casing 144, and a second passage 145. The first passage 143 includes an inlet 141 formed at a first end adjacent to the suction port 123. A second end of the first passage 143, which is opposite to the inlet 141, is in fluid communication with the impeller casing 144. A first end of the second passage 145 is in fluid communication with the impeller casing 144, and a second end of the second passage 145 opposite to the first end is in fluid communication with a dust inlet 153 of the dust receptacle 150. The impeller casing 144 has an inner diameter larger than an outer diameter of the impeller 135 to allow rotation of the impeller 135 housed therein. Accordingly, dust entering the inlet 141 passes through the first passage 143, the impeller casing 144 and the second passage 145 in sequence, before being collected in the dust receptacle 150.

Figure 8:
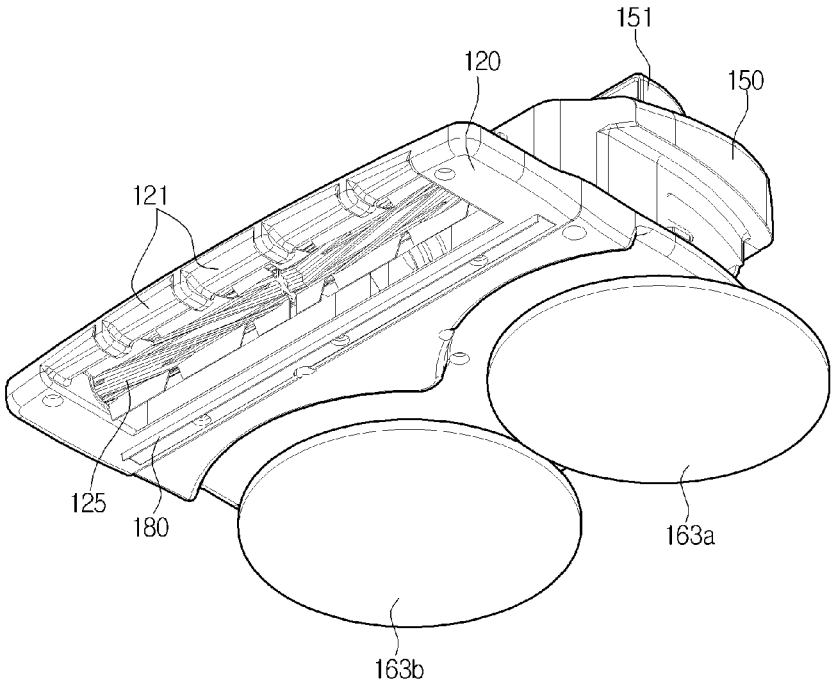
FIG. 8 is a bottom perspective view of the suction port assembly illustrated in FIG. 1.

The lower casing 120 may also include a partition rib 180 (FIG. 8) to divide the lower space of the lower casing 120 where the suction port 123 is formed, into a vacuum cleaning area and a steam cleaning area on which floorcloths 163*a* and 163*b* are arranged. The partition rib 180 may extends along the entire length of the suction port 123 and may be located behind the suction port 123.

Figure 13:
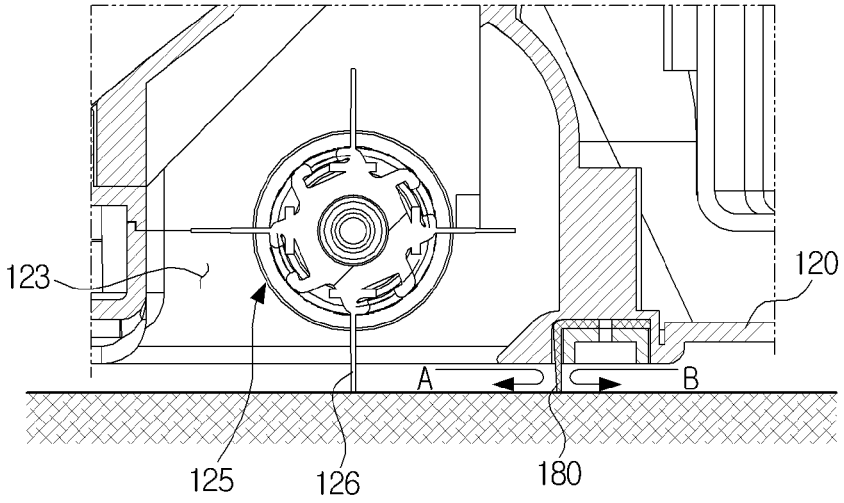
FIG. 13 is a partially enlarged sectional view illustrating the operation of a screening member attached to the bottom of the suction port assembly.
Figure 14:
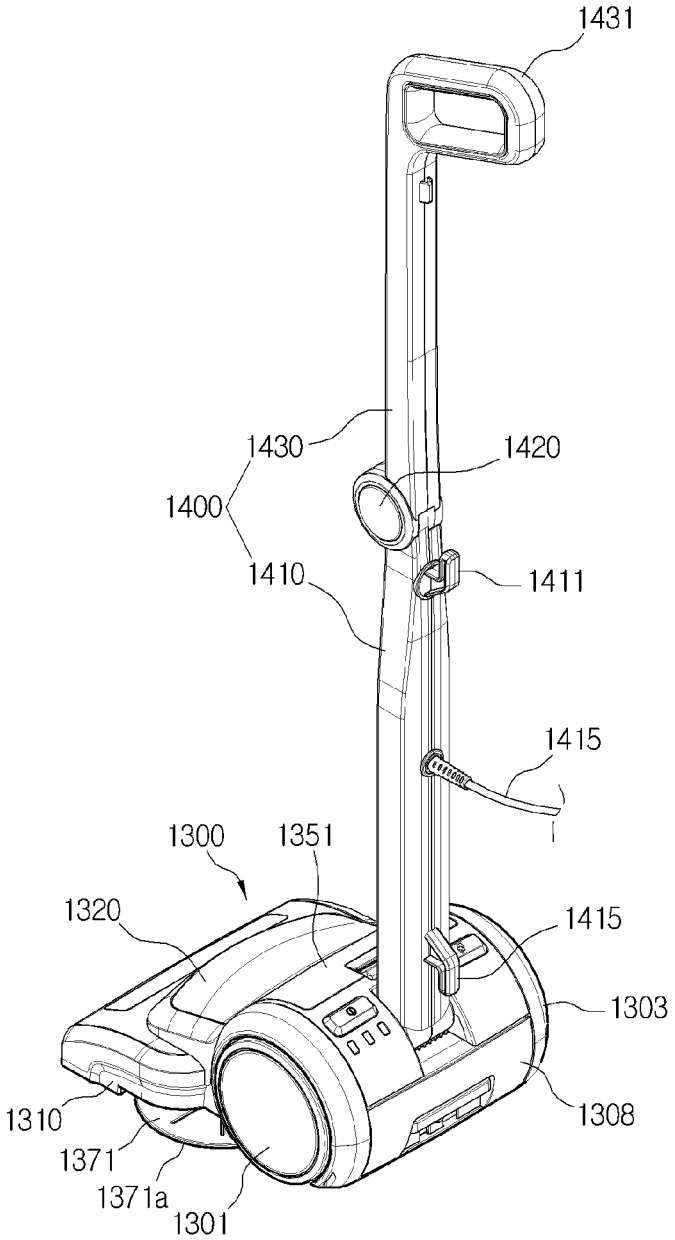
FIG. 14 is a perspective view of a steam vacuum cleaner according to a second exemplary embodiment of the present invention.
Figure 15:
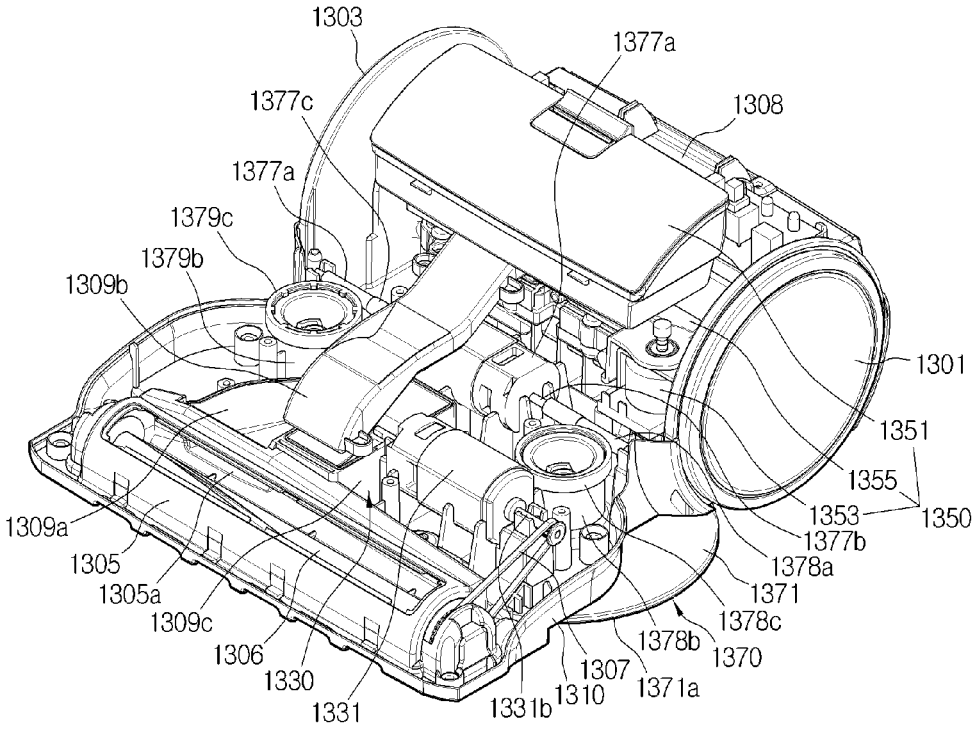
FIG. 15 is a top internal perspective view of the suction port assembly illustrated in FIG. 14.
Figure 16:
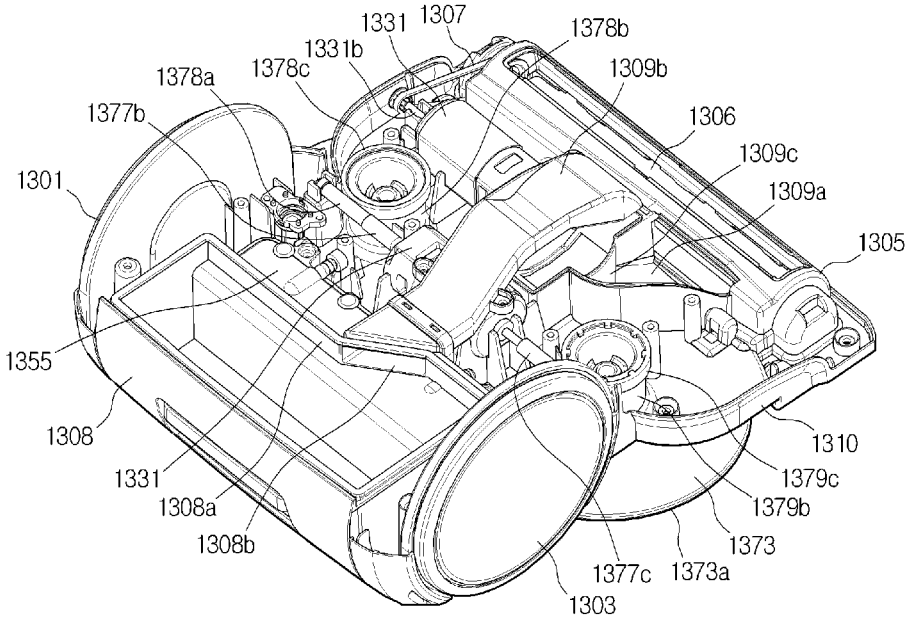
FIG. 16 is a bottom internal perspective view of the suction port assembly illustrated in FIG. 14.
Figure 17:
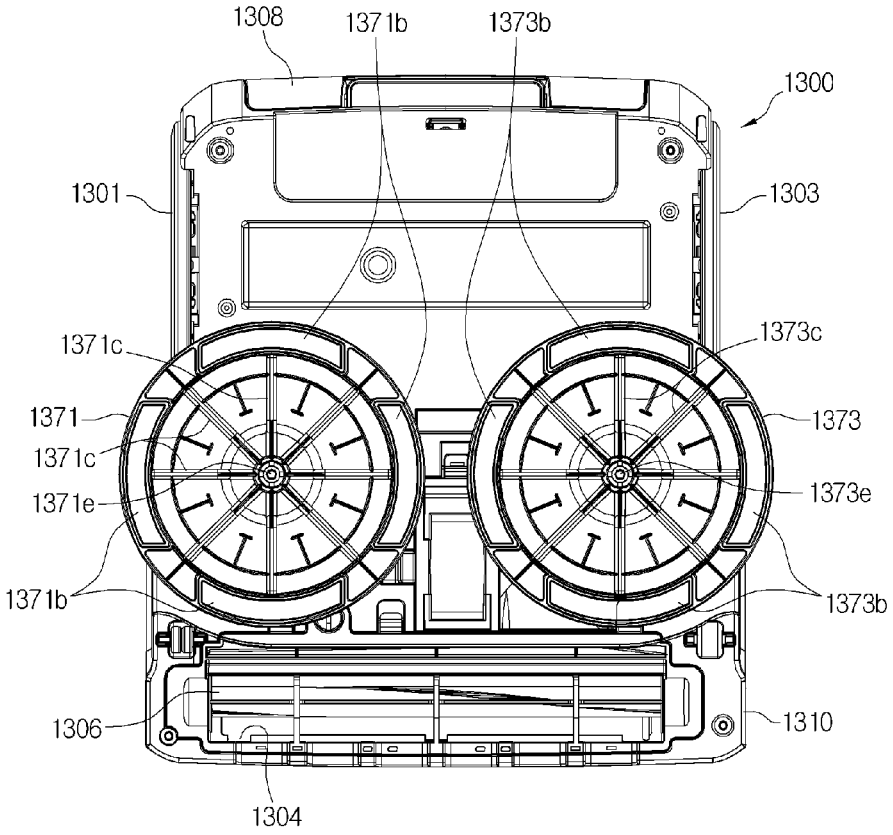
FIG. 17 is a bottom perspective view of the suction port assembly illustrated in FIG. 14.

Referring to FIG. 13, the lower portion of the partition rib 180 contacts an object being cleaned to prevent dust suctioned through the suction port 123 from mixing with the steam, or being moistened by the steam and adhering to the object. A steam ejecting hole (not illustrated) is formed in a lower rear portion of the lower casing 120 to eject the steam.

Figure 4:
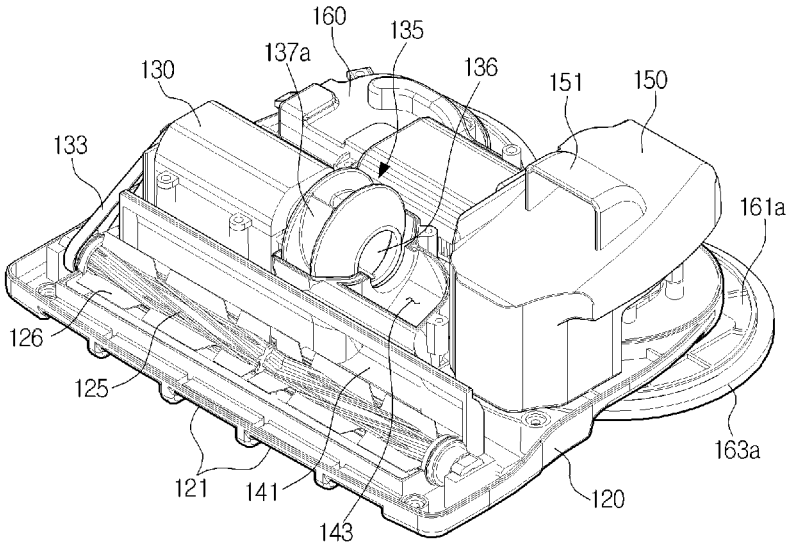
FIG. 4 is another perspective view of a suction port assembly from which an upper cover illustrated in FIG. 1 is removed.

The motor 130 according to the first exemplary embodiment of the present invention may consume approximately 80 W to 100 W of power, which is different from a general suction motor of a vacuum cleaner that consumes approximately 700 W to 800 W of power. The heater unit 240 (FIG. 10) may use AC power, and it is desirable that the motor 130 also uses AC power. Referring to FIGS. 3 and 4, the motor 130 may include a driving shaft 131 engaged with the center of rotation of the impeller 135 to drive the impeller 135. The driving shaft 131 remains parallel to the drum brush 125 when the motor 130 is mounted in the lower casing 120 so that the driving force of the motor 130 can be directly transmitted to the drum brush 125 via the driving belt 133. A driving force transmitting means (not illustrated) may be formed on one end of the driving shaft 131 of the motor 130 to transmit the driving force to the rotating unit 160. Accordingly, by the rotation of the driving shaft 131, the motor 130 transmits a driving force to the drum brush 125, the impeller 135, and the rotating unit 160 concurrently.

Figure 5:
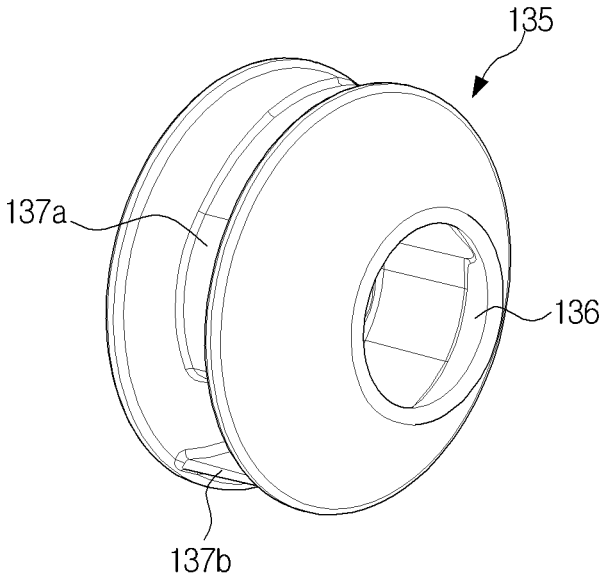
FIG. 5 is a perspective view of the impeller illustrated in FIG. 4.
Figure 6:
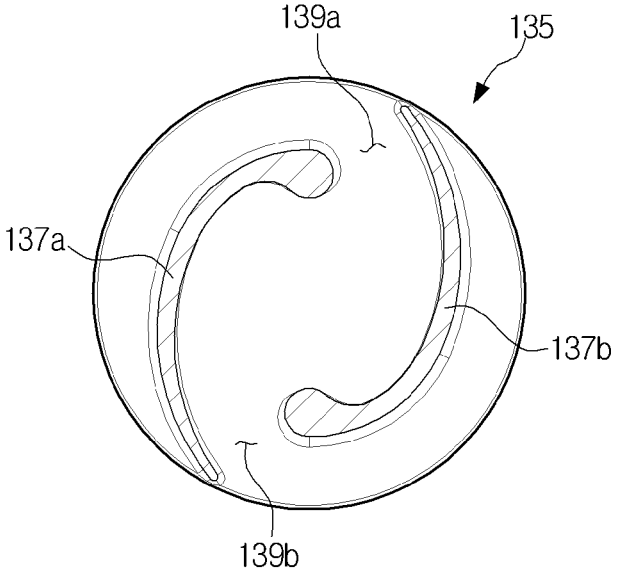
FIG. 6 is a sectional view of the impeller illustrated in FIG. 4.
Figure 7:
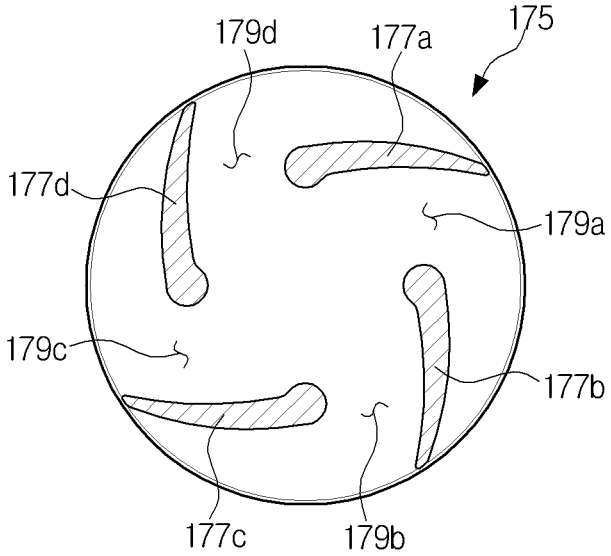
FIG. 7 is a sectional view of another embodiment of the impeller.

Referring to FIGS. 5 and 6, the impeller 135 has a suction hole 136 formed at the center of one end closer to the first passage 143 to guide the dust and air exiting out of the first passage 143 and entering into the impeller 135. The impeller 135 also includes a pair of blades 137*a* and 137*b* formed in a symmetrical manner with respect to the center of rotation of the impeller 135. The blades 137*a* and 137*b* are formed to have a predetermined radius of curvature. The ends of the blades 137*a* and 137*b* are distanced from each other so as to create a pair of discharge openings 139*a* and 139*b* therebetween. Accordingly, dust is suctioned through the suction hole 136 and discharged through the discharge holes 139*a* and 139*b* by the impeller 135 by centrifugal force, passed through the second passage 145 and deposited into the dust receptacle 150. The impeller 135 may have a plurality of blades and is not particularly limited to two blades as described in the present embodiment. Referring to the example illustrated in FIG. 7, the impeller 175 may include four blades 177*a*, 177*b*, 177*c* and 177*d* to further enhance the flow rate of the discharged dust-entrained air. Discharge openings 179*a*, 179*b*, 179*c* and 179*d* are formed between the blades 177*a*, 177*b*, 177*c* and 177*d*.

At least the upper portion of the dust receptacle 150 may be made out of translucent material. The translucent upper portion of the dust receptacle 150 is visible from outside of the suction port assembly 100 when the dust receptacle 150 is seated in the hole 113 of the upper casing 110 to allow a user to look inside the dust receptacle 150 and check the amount of dust collected therein. The dust receptacle 150 may also include a discharge part 155 (FIG. 2) to discharge the dust and air outside. The discharge part 155 may include a filter (not illustrated) to filter minute dust from the air being discharged out of the dust receptacle 150.

The rotating unit 160 is arranged on the lower casing 120 and in back of the motor 130. The rotating unit 160 includes a plurality of worm gears (not illustrated) and bevel gears (not illustrated). The rotating unit 160 receives driving force from the motor 130 to rotate the pair of circular floorcloth plates 161*a* and 161*b* attached to the lower portion of the lower casing 120. The pair of floorcloth plates 161*a* and 161*b* may include Velcro tapes (not illustrated) disposed on the lower portions to be attached to or detached from the floorcloths 163*a* and 163*b*.

Figure 9:
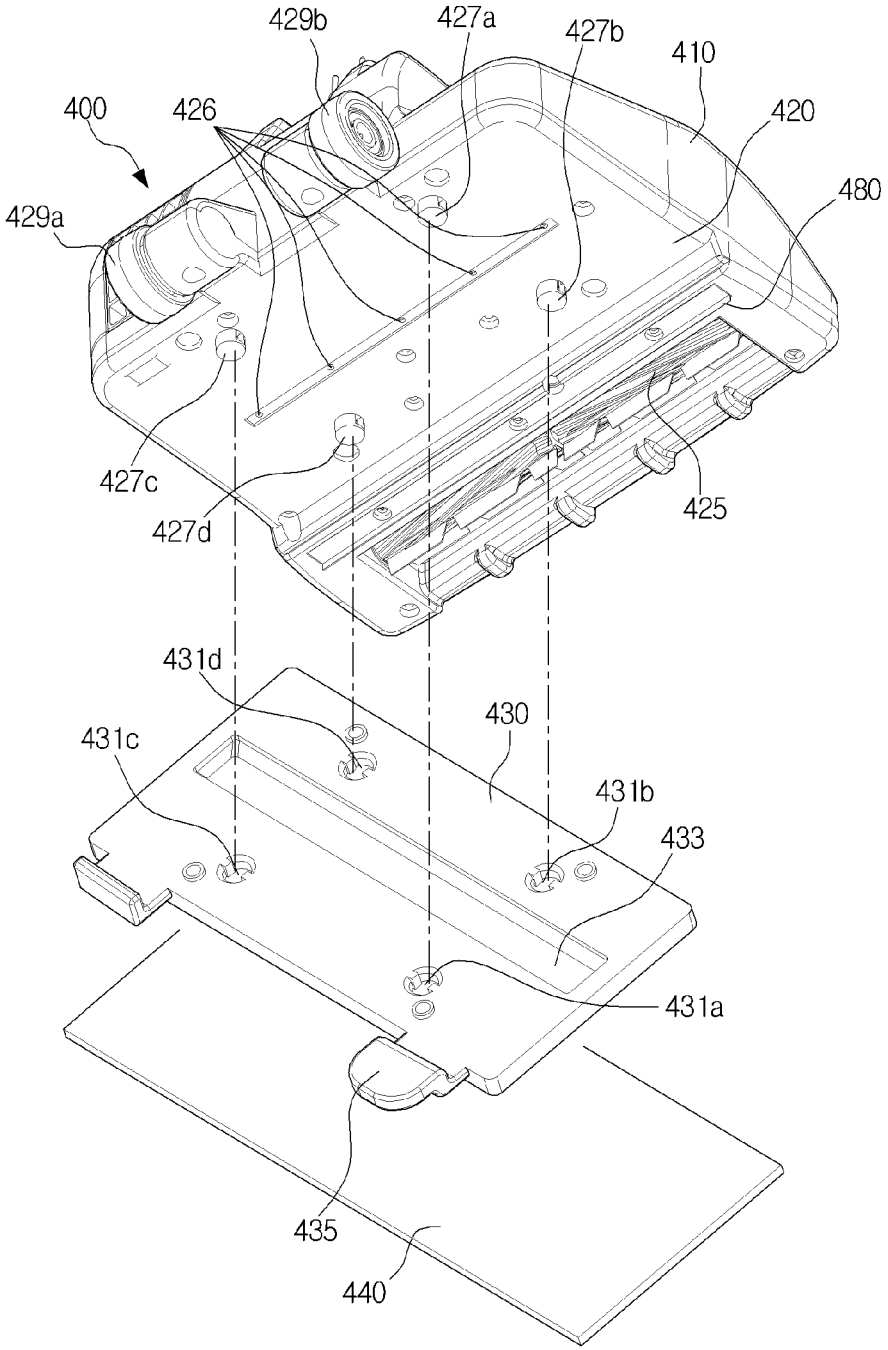
FIG. 9 is an exploded view illustrating a stationary floorcloth plate applied to the suction port assembly.

The floorcloths 163*a* and 163*b* may be stationary instead of being rotatable. Referring to FIG. 9, a combination of a floorcloth plate 430, which is detachably attached to the rear portion of the partition rib 480 on the lower portion of the lower casing 420, and a rectangular floorcloth 440, which is detachably attached to the lower portion of the floorcloth plate 430, may be employed. The floorcloth plate 430 includes a plurality of spaced holes 431*a*, 431*b*, 431*c*, and 431*d* formed on the upper portion thereof to be snap-engaged with a plurality of protrusions 427*a*, 427*b*, 427*c*, and 427*d* formed on a part of the lower portion of the lower casing 420 where the floorcloth plate 430 is placed.

The floorcloth plate 430 may also include an elongated hole 433 to allow streams of steam, which are emitted out of a plurality of steam holes 426 formed on the lower casing 420, to hit the object being cleaned without being obstructed by the floorcloth plate 430. The floorcloth plate 430 may include a foot-operating pedal 435 extending from the rear portion so that a user can step on the foot-operating pedal 435 and disengage the floorcloth plate 430 from the lower casing 420. When a stationary floorcloth 440 is employed, the rotating unit 160 is not necessarily employed in the suction port assembly 400. In FIG. 9, reference numeral 410 denotes the upper casing, 425 is the drum brush, and 429 is the wheel.

Figure 10:
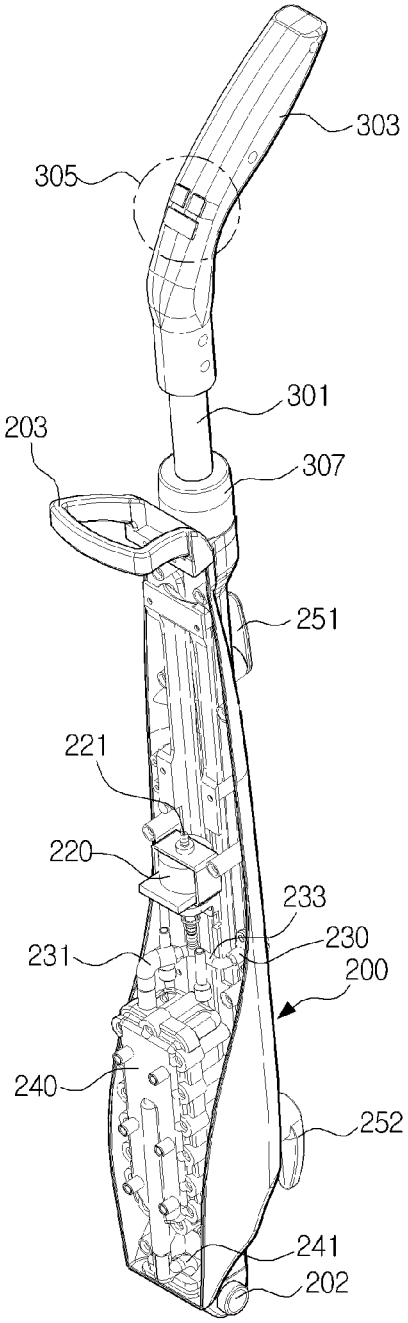
FIG. 10 is a perspective view illustrating an interior of the main body illustrated in FIG. 1.

Referring to FIGS. 1, 2 and 10, the main body 200 includes a front cover 201. The front cover 201 may include an opening 207 formed on the upper portion to receive a removable water tank 210 therein, and a locking button 211 to lock the water tank 210 in place or release the water tank 210 from the locked state. The main body 200 may also include a carrier handle 203 extending forward at an angle so that a user can grip the carrier handle 203 and carry the cleaner. The main body 200 may also include a handle member receiving part 205 extending along the length of the main body 200 in the rear portion so that the handle member 301 may slide into or out of the handle member receiving part 205, and a pair of wire winding projections 251 and 252 spaced vertically apart from each other, around which electric wires (not illustrated) are wound. Elements such as pump 220, safety valve 230, and heater unit 240 are all housed in the main body 200.

A rear portion of the water tank 210 is inserted in the main body 200. The water tank 210 is removable through the opening 207. The water tank 210 may be made out of a translucent material to allow a user to check the water level through the front side of the water tank 210 which is visible to the outside of the main body 200.

The pump 220 receives water from the water tank 210 through an inlet port 221 and supplies a predetermined amount of water to the heater unit 240 through a water pipeline 231. A discharge pipe 233, in fluid communication with the main body 200, is formed on one side of the water pipeline 231. The safety valve 230 is installed on the discharge pipe 233 to prevent backflow of water into the pump 220 when the water supply is obstructed due to pressure inside the heater unit 240. The discharge pipe 233 discharges water outside the main body 200.

Unlike small-sized heater units employed in conventional steam cleaners, the heater unit 240 according to the first embodiment of the present invention employs a sheath heater which consumes approximately 1200 W to 1900 W of power, and a large-sized heater unit 240 which holds approximately 700 cc to 900 cc of water. If the motor 130 consumes approximately 80 W to 100 W of power, the cleaner consumes a maximum of 1400 W of power. Accordingly, the steam vacuum cleaner according to the exemplary embodiment of the present invention can save approximately 600 W of power, when compared to conventional steam vacuum cleaners that consume approximately 2000 W of power. Since the heater unit 240 holds a large amount of water, the possibility of steam emitting pipe 241 becoming clogged by scale formation is greatly decreased due to increased inner area.

Figure 11:
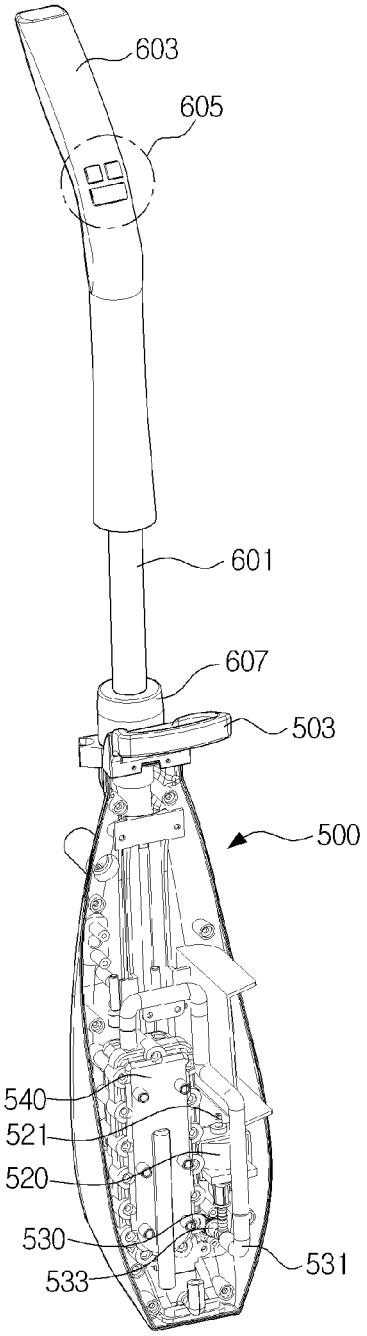
FIG. 11 is a perspective view illustrating another embodiment of the main body.

Referring to FIG. 10, the main body 200 may have a relatively slim shape because the pump 220 is arranged on the upper portion of the heater unit 240. However, many other configurations are possible. For example, the pump 520 may be arranged on a side portion of the heater unit 540 (FIG. 11). In this case, the height of the main body 500 is reduced and therefore, the cleaner can be compact-sized. Both the main bodies 500 and 200 illustrated in FIGS. 11 and 10, respectively, have substantially the same construction, with the exception of the location of the pump 520. In FIG. 11, reference numeral 503 denotes the carrier handle, 521 is the inlet port, 530 is the safety valve, 531 is the water pipeline, 533 is the discharge pipe, 601 is the handle member, 603 is the operating handle, 605 is the operating button part, and 607 is the handle member fixing part.

Referring to FIG. 10, the handle member 301 has a predetermined length, and can be withdrawn out of the handle member receiving part 205 (FIG. 2) or inserted therein according to the height of a user. The handle member fixing part 307 arranged on the upper portion of the handle member receiving part 205 locks or unlocks the handle member 301.

The operating handle 303 is engaged with the upper portion of the handle member 301 for the grip of a user, and includes the operating button part 305 having a plurality of buttons to operate the motor 130 and the heater unit 240. The user may operate vacuum cleaning and steam cleaning concurrently or separately, through manipulation of the operating button part 305.

An example of operating both vacuum and steam cleaning concurrently using the steam vacuum cleaner constructed as explained above according to the first exemplary embodiment of the present invention will be explained below.

When a user selects to drive the motor 130 and the heater unit 240 through the operating button part 305, the cleaner starts vacuum and steam cleaning. For vacuum cleaning, the driving shaft 131 of the motor 130 rotates, thereby driving the drum brush 125, the impeller 135, and the rotating unit 160 concurrently.

Figure 12:
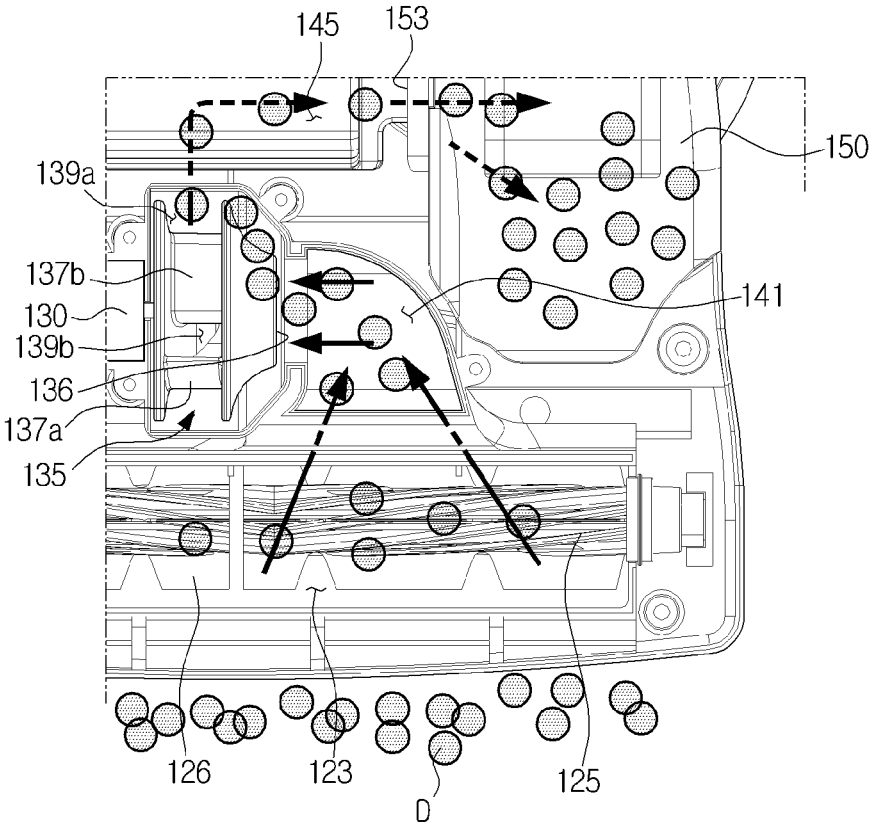
FIG. 12 illustrates contaminants being drawn from an object being cleaned into the suction port assembly.

Referring to FIG. 12, the drum brush 125 rotates so that the cleaning ribs 126 contact an object being cleaned to move the dust D to the inlet 141 of the first passage 143. The dust D is suctioned through the inlet 141 by the suction force generated from the rotating impeller 135, guided through the first passage 143 into the suction hole 136 of the impeller 135.

Dust is separated in the impeller 135 by centrifugal force, discharged through the discharge openings 139*a* and 139*b*, guided through the second passage 145, and deposited into the dust receptacle 150 through the dust inlet 153. Since passages 143, 144, and 145 are relatively short, less force is required to suction dust into the dust receptacle 150, and, as a result, a low-power consuming AC motor 140 can be used without decreasing the efficiency of the cleaner.

Referring to FIG. 10, for steam cleaning, the sheath heater (not illustrated) housed inside the heater unit 240 is heated, thereby heating the water in the heater unit 240 into steam. The steam is then emitted onto an object being cleaned through the steam emitting pipe 241 and the steam emitting holes (not illustrated) of the lower casing 120.

Referring to FIG. 4, the pair of floorcloth plates 161*a* and 161*b* are rotated in accordance with the driving of the rotating unit 160, to rotate the floorcloths 163*a* and 163*b* attached to the lower portion to wipe out the steam-heated object. Referring to FIG. 13, the streams of emitted steam are blocked from moving toward the suction port 123 due to the presence of the partition rib 180. Additionally, because dust D is also blocked by the partition rib 180 from moving toward the steam while being brushed and moved to the inlet 141 by the drum brush 125, dust D is not mixed with the steam. Additionally, the problem of dust D being moistened by the steam being emitted and adhering to the object being cleaned can be avoided.

The structure of a steam vacuum cleaner according to a second exemplary embodiment of the present invention will be explained with reference to the drawings. Referring to FIGS. 14 to 17, the steam vacuum cleaner according to the second exemplary embodiment of the present invention may include a suction port assembly 1300, a pump 1330, a steam unit 1350, a floorcloth unit 1370, and a handle member 1400.

The suction port assembly 1300 may include a main body 1310 and a cover 1320 which is engaged with an upper portion of the main body 1310. Wheels 1301 and 1303 are rotatably mounted at the rear of both ends of the suction port assembly 1300 such that the cleaner can move over a surface being cleaned.

A suction hole 1304 is formed on a front bottom surface of the main body 1310 and a brush housing 1305 is formed on an upper side of the main body 1310 at a position corresponding to the suction hole 1304. A drum brush 1306 is rotatably mounted in the brush housing 1305 so that dust is sucked in from a surface being cleaned toward the suction hole 1304. Both ends of the drum brush 1306 are supported by respective sides of the brush housing 1305, and one end 1306*a* (FIG. 18) of the drum brush 1306 is connected to a second driving shaft 1331*b* of a first motor 1331 through a belt 1307 in order to receive a driving force from the first motor 1331 of the pump 1330.

A dust receptacle 1308 is detachably attached to a rear side of the main body 1310, and the main body 1310 may include first and second suction passages 1309*a* and 1309*b*, respectively, which connect the suction hole 1304 to the dust receptacle 1308. One end of the first suction passage 1309*a* is connected to an inlet hole 1305*a* of the brush housing 1305, and the other end is connected to an impeller casing part 1309*c* disposed on one end of the brush housing 1305. One end of the second suction passage 1309*b* is connected to the impeller casing part 1309*c*, and the other end is connected to an outlet hole 1308*b* of a dust receptacle casing part 1308*a* surrounding the dust receptacle 1308. Dust-laden air flowing into the brush housing 1305 through the suction hole 1304 flows into the inlet hole 1305*a*, passes through the first suction passage 1309*a*, the impeller casing part 1309*c*, and the second suction passage 1309*b*, and is collected in the dust receptacle 1308 though the outlet hole 1308*b*. The dust receptacle 1308 includes a filter 1308*c* (FIG. 18) on an upper portion thereof, thereby preventing leakage of fine particles of dust.

Figure 18:
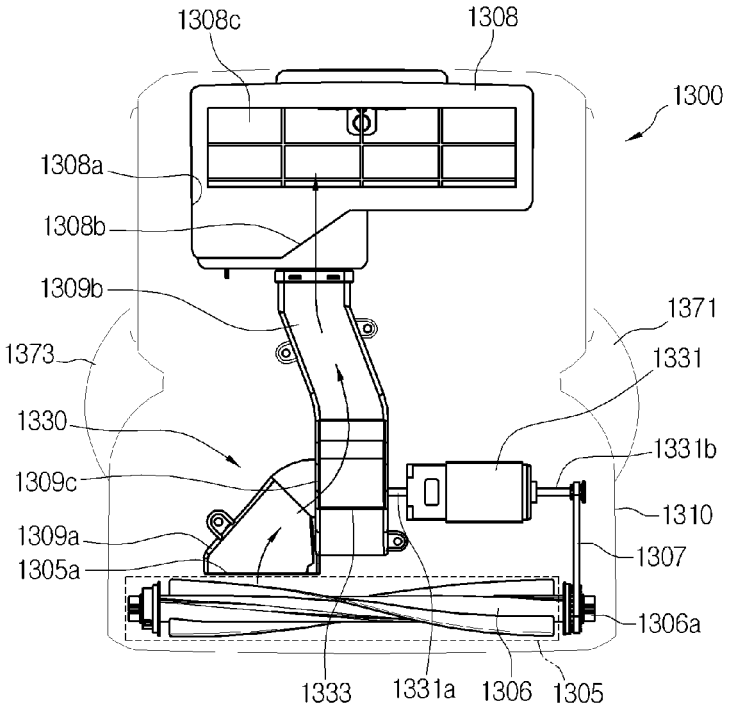
FIG. 18 is a plan view of a pump and a passage which are disposed in the suction port assembly.

Referring to FIG. 18, the pump 1330 may include a first motor 1331 and an impeller 1333. The first motor 1331 is disposed outside of the impeller casing part 1309*c*. The impeller 1333 is rotatably mounted on the impeller casing part 1309*c*, and receives a driving force of the first 1331 motor by the rotation of a first driving shaft 1331*a*. The impeller casing part 1309*c* is penetrated by the first driving shaft 1331*a* of the first motor 1331, and is sealed by a sealing member (not shown) to prevent pressure loss from the first and second suction passages 1309*a* and 1309*b*. The pump 1330 rotates the impeller 1333, maintains vacuum condition inside the first and second suction passages 1309*a* and 1309*b*, and pumps air and dust from the suction hole 1304 in order to collect the dust into the dust receptacle 1308.

Figure 19:
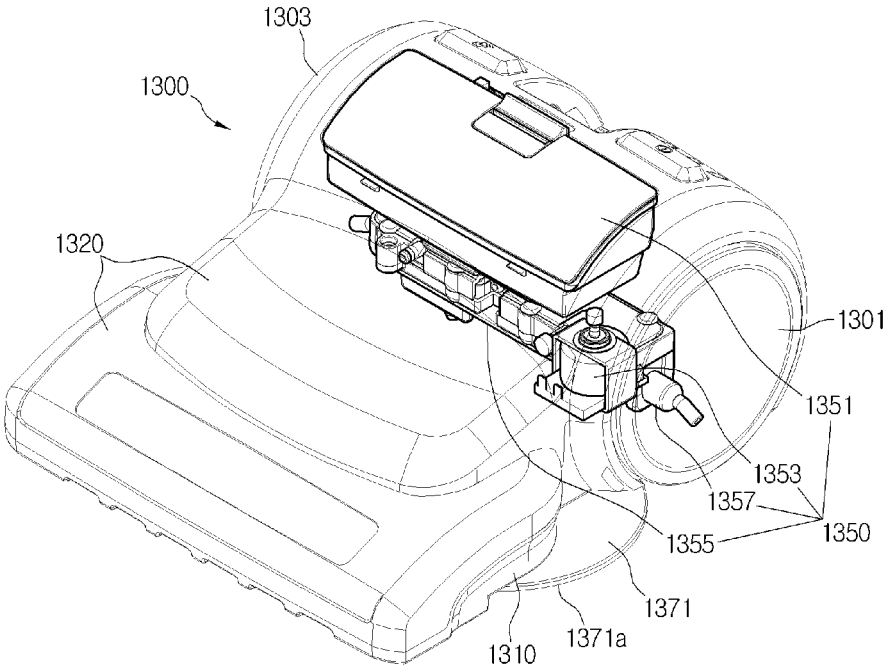
FIG. 19 is a perspective view of a steam hole disposed in the suction port assembly.
Figure 20:
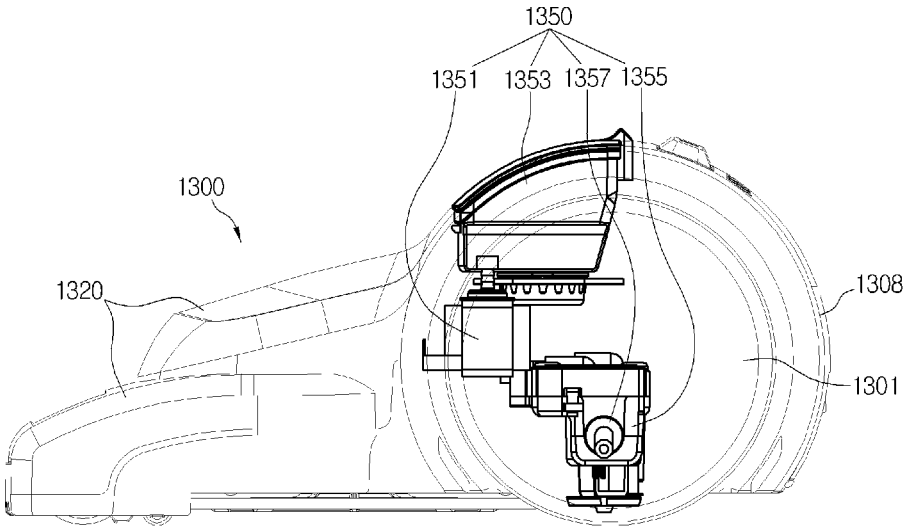
FIG. 20 is a side view of the steam hole disposed in the suction port assembly.

Referring to FIGS. 19 and 20, the steam unit 1350 is disposed on a rear portion of the suction port assembly 1300, and may include a water tank 1351, a pump 1353, a heater housing 1355, and a sheath heater 1357. Part of the water tank 1351 is detachably inserted into the cover 1320. One side of the pump 1353 is connected to the water tank 1320, and supplies a predetermined amount of water stored in the water tank 1320 to the heater housing 1355. The pump 1353 may employ a micro pump to supply the small amount of water periodically or continuously to the heater housing 1355. The heater housing 1355 is disposed under the water tank 1351, and part of the sheath heater 1357 is inserted into the heater housing 1355, so that the sheath heater 1357 heats water flowing into the heater housing 1355 instantaneously. The steam unit 1350 according to the second exemplary embodiment of the present invention generates steam by instantaneously heating water, but this should not be considered limiting.

Figure 21:
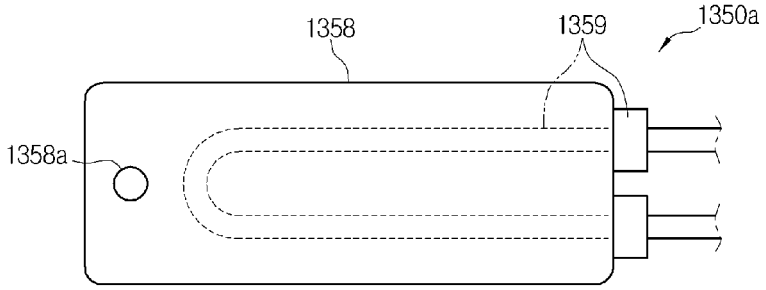
FIG. 21 is a sectional view of another embodiment of the steam hole illustrated in FIG. 19.

A steam unit 1350*a* may be implemented in a water tank type. Referring to FIG. 21, the steam unit 1350*a* may include a water tank 1358 and a sheath heater 1359, part which is inserted into the water tank. The steam unit 1350*a* heats water stored in the water tank 1358 using the sheath heater 1359 and supplies steam to the floorcloth unit. In this case, a user may fix the water tank 1358 to the cover, and pour water into the water tank 1358 through a water pouring part 1358*a* formed on an upper portion of the water tank 1358.

Figure 22:
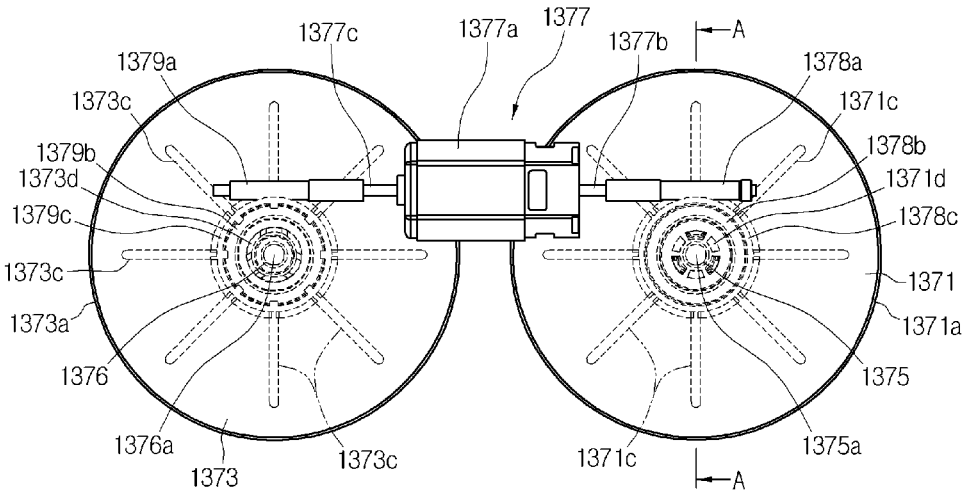
FIG. 22 is a plan view of a floorcloth illustrated in FIG. 15.
Figure 23:
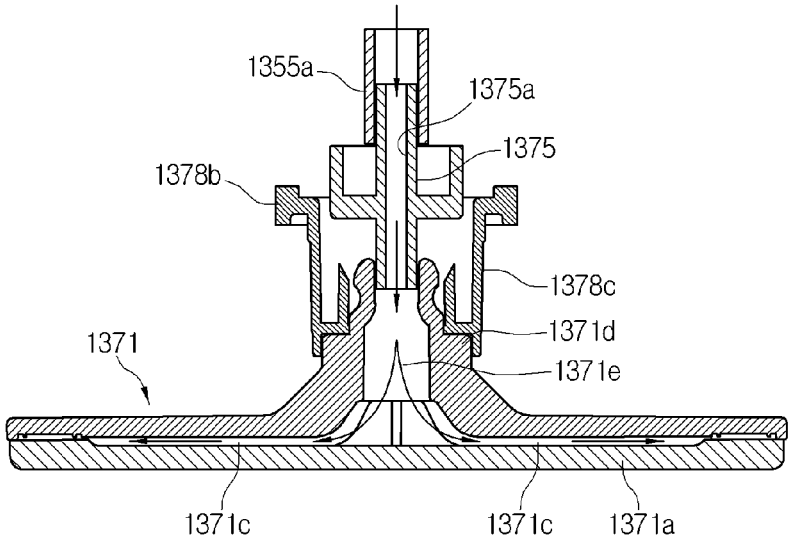
FIG. 23 is a sectional view taken along the line A-A illustrated in FIG. 22.

Referring to FIGS. 22 and 23, the floorcloth unit 1370 may include a pair of floorcloth plates 1371 and 1373, and a rotation driving part 1377. The floorcloth plates 1371 and 1373 are rotatably formed on a lower portion of the main body 1310 of the suction port assembly 1300. The floorcloth plates 1371 and 1373 may be disposed at a rear portion of the suction hole 1304 (see FIG. 17) in order to prevent a collision of dust and air flowing into the suction hole 1304. The floorcloth plates 1371 and 1373 are formed in a substantially circular shape. The pair of floorcloth plates 1371 and 1373 may include a plurality of floorcloth attaching parts 1371*b* and 1373*b* (FIG. 17), respectively, which are attached to a bottom surface thereof and steam passages 1371*c* and 1373*b*, respectively, radiating from the center.

The floorcloth plates 1371 and 1373 include protrusions 1371*d* and 1373*d*, respectively, which protrude from an upper center surface of each floorcloth plate 1371 and 1373, and the protrusions 1371*d* and 1373*d* are pressed into cylinder parts 1378*b* and 1379*b*, respectively. Steam discharging holes 1371*e* and 1373*e* are formed inside the pair of protrusions 1371*d* and 1373*d*, and the protrusions 1371*d* and 1373*d* are connected to through holes 1375*a* and 1376*a*, respectively, which are formed in a pair of connecting shafts 1375 and 1376. The through holes 1375*a* and 1376*a* are connected to a steam supply pipe 1355*a* connected to the heater housing 1355. Steam supplied from the steam unit 1350 flows in the through holes 1375*a* and 1376*b*, the steam discharging holes 1371*e* and 1373*e*, and steam passages 1371*c* and 1373*c*. In doing so, steam saturates the floorcloths 1371*a* and 1373*a* attached on the pair of floorcloth plates 1371 and 1373.

The rotation driving part 1377 may include a second motor 1377*a*, a pair of worms 1378*a* and 1379*a*, and a pair of worm gears 1378*c* and 1379*c*. The second motor 1377*a* is disposed between the pair of connecting shafts 1375 and 1376, and a pair of driving shafts 1377*b* and 1377*c* are extended to the pair of connecting shafts 1375 and 1376, respectively. The worms 1378*a* and 1379*a* are formed around the circumference of the pair of driving shafts 1377*b* and 1377*c*, respectively, and the worm gears 1378*c* and 1379*c* are extendedly formed around circumferences of the cylinder parts 1378*b* and 1379*b*, respectively. The pair of worms 1378*a* and 1379*a* and the pair of work gears 1378*c* and 1379*c* transfer the driving force of the second motor 1377*a* to the pair of connecting shafts 1375 and 1376, which causes the pair of floorcloth plates 1371 and 1373 to concurrently rotate in different directions.

Figure 24:
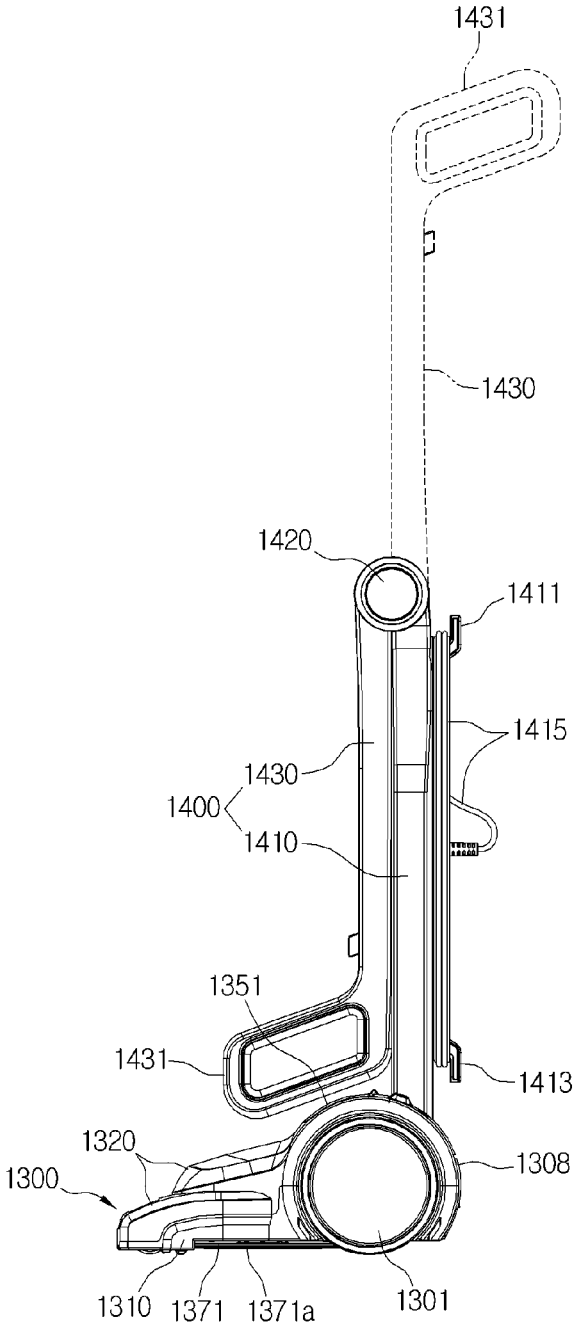
FIG. 24 is a side view of folding or unfolding condition of a handle member illustrated in FIG. 14.

Referring to FIG. 24, the handle member 1400 may include a first member 1410 and a second member 1430 which overlap. One end of the first member 1410 is hinged with a rear portion of the suction port assembly 1300, and one surface includes at least one pair of supporting protrusions 1411 and 1413 which are vertically disposed at a predetermined interval. Electric wires may be wound around the pair of supporting protrusions 1411 and 1413.

One end of the second member 1430 is hinged with another end of the first member 1410 by a hinge part 1420, and a handle 1431 extends to another end of the second member 1430. The second member 1430 rotates 180 degrees and folds to contact the first member 1410. The second member 1430 may be folded so as not to impact the pair of supporting protrusions 1411 and 1413. When a vacuum cleaner is not in use, the handle member 1400 may be folded allowing easy storage of the vacuum cleaner in a small space.

While certain exemplary embodiments of the present invention have been shown and described with reference to certain preferred embodiments thereof, it will be understood by those skilled in the art that various changes in form and details may be made therein without departing from the spirit and scope of the invention as defined by the appended claims and their equivalents.

What is claimed is:

1. A steam vacuum cleaner, comprising:

a suction port assembly including a suction hole formed on a bottom surface thereof and a dust receptacle detachably attached to the suction port assembly;

a pump disposed in the suction port assembly to suction dust-laden air from an object being cleaned and to transfer the dust laden air to the dust receptacle, the pump including an impeller formed on an upper stream in comparison with the dust receptacle with respect to a dust transfer direction, an impeller casing housing the impeller and a first motor to drive the impeller;

a steam unit disposed on the suction port assembly;

a floorcloth unit disposed on the suction port assembly to scrub the object using steam supplied from the steam unit; and a handle member hinged with a portion of the suction port assembly, wherein the handle member has a variable length, wherein a passage is connected between the impeller casing and the dust receptacle.

2. The steam vacuum cleaner of claim 1, wherein the handle member includes:

a first member, wherein one end of the first member is connected to the suction port assembly; and a second member hinged with another end of the first member, wherein the second member folds into a folded position in which it contacts the first member.

3. The steam vacuum cleaner of claim 2, wherein the first member includes:

at least one pair of protrusions longitudinally disposed at predetermined intervals.

4. The steam vacuum cleaner of claim 3, wherein the second member does not contact the pair of protrusions in the folded position.

5. The steam vacuum cleaner of claim 1, wherein the impeller is formed on a passage connecting the suction hole and the dust receptacle; and the motor is disposed outside of the passage to drive the impeller.

6. The steam vacuum cleaner of claim 1, wherein the floorcloth unit includes:

at least two floorcloth plates rotatably mounted on the bottom surface of the suction port assembly, wherein a floorcloth is attached to a bottom surface of each floorcloth plate; and a rotation driving part to drive the at least two floorcloth plates, wherein each floorcloth plate includes:

a plurality of steam passages radially formed on the bottom surface of the floorcloth plate.

7. The steam vacuum cleaner of claim 6, wherein the at least two floorcloth plates guide steam supplied from the steam unit to the steam passage of the floorcloth plates through a pair of connecting shafts of the floorcloth plates.

8. The steam vacuum cleaner of claim 1, wherein the impeller is formed on a passage connecting the suction hole and the dust receptacle; and the motor is disposed outside of the passage to drive the impeller, wherein the floorcloth unit includes:

at least two floorcloth plates rotatably mounted on the bottom surface of the suction port assembly, wherein a floorcloth is attached to a bottom surface of each floorcloth plate; and a rotation driving part to receive driving force from the first motor to drive the pair of floorcloth plates.

9. The steam vacuum cleaner of claim 8, wherein each floorcloth plate includes:

a plurality of steam passages radially formed on the bottom surface of the floorcloth plate.

10. The steam vacuum cleaner of claim 1, wherein the steam unit includes:

a water tank;

a heater housing;

a sheath heater, wherein a part of the sheath heater is inserted into the heater housing; and a pump to supply water stored in the water tank to the heater housing.

11. The steam vacuum cleaner of claim 1, wherein the steam unit includes:

a water tank; and a sheath heater, wherein a part of the sheath heater is inserted into the water tank.

12. The steam vacuum cleaner of claim 1, wherein the suction port assembly further includes:

a drum brush rotatably mounted in the suction hole.

* * * * *